US010190383B2

(12) United States Patent
Mullin et al.

(10) Patent No.: US 10,190,383 B2
(45) Date of Patent: Jan. 29, 2019

(54) SYSTEM AND METHOD FOR FLUID INJECTION

(71) Applicant: Cameron International Corporation, Houston, TX (US)

(72) Inventors: Michael David Mullin, Longford (IE); Kevin Peter Minnock, Houston, TX (US)

(73) Assignee: Cameron International Corporation, Houston, TX (US)

( * ) Notice: Subject to any disclaimer, the term of this patent is extended or adjusted under 35 U.S.C. 154(b) by 750 days.

(21) Appl. No.: 14/681,990

(22) Filed: Apr. 8, 2015

(65) Prior Publication Data

US 2016/0215585 A1 Jul. 28, 2016

Related U.S. Application Data

(60) Provisional application No. 62/107,317, filed on Jan. 23, 2015.

(51) Int. Cl.

| | |
|---|---|
| ***E21B 33/06*** | (2006.01) |
| ***E21B 33/068*** | (2006.01) |
| ***E21B 43/16*** | (2006.01) |
| ***E21B 43/20*** | (2006.01) |

(52) U.S. Cl.
CPC ..... *E21B 33/068* (2013.01); *E21B 43/16* (2013.01); *E21B 43/20* (2013.01)

(58) Field of Classification Search
CPC ..... E21B 33/068; E21B 43/16
USPC ..... 166/305.1
See application file for complete search history.

(56) References Cited

U.S. PATENT DOCUMENTS

| | | | | |
|---|---|---|---|---|
| 3,378,074 A | | 4/1968 | Kiel | |
| 3,730,273 A | * | 5/1973 | Wilson | E21B 43/14 166/269 |
| 4,274,749 A | * | 6/1981 | Lake | B01F 5/0403 137/896 |

(Continued)

FOREIGN PATENT DOCUMENTS

| | | | |
|---|---|---|---|
| EP | 0119665 | A2 | 9/1984 |
| WO | 2014/178723 | A1 | 11/2014 |
| WO | 2015112908 | A2 | 7/2015 |

OTHER PUBLICATIONS

PCT International Search Report and Written Opinion; Application No. PCT/US2016/014610; dated May 10, 2016; 14 pages.

(Continued)

*Primary Examiner* — Zakiya W Bates
*Assistant Examiner* — Ashish K Varma
(74) *Attorney, Agent, or Firm* — Fletcher Yoder, P.C.

(57) ABSTRACT

A fluid injection system includes a choke valve having at least one inlet. The system also includes a water injection line extending between a water supply and the choke valve, and the water injection line is configured to flow water from the water supply into a first inlet of the at least one inlet of the choke valve. The system also includes a polymer injection line extending from a polymer supply toward the choke valve, and the polymer injection line is configured to flow a polymer in a substantially non-inverted state from the polymer supply toward the choke valve. The choke valve is configured to receive the water and the polymer and to facilitate inversion of the polymer as the water and the polymer flow through the choke valve.

20 Claims, 6 Drawing Sheets

(56) References Cited

U.S. PATENT DOCUMENTS

| | | | | |
|---|---|---|---|---|
| 4,276,904 | A | | 7/1981 | Jackson |
| 4,386,806 | A | | 6/1983 | Axen et al. |
| 4,683,951 | A | | 8/1987 | Pathak et al. |
| 4,687,059 | A | | 8/1987 | Pathak et al. |
| 5,067,508 | A | * | 11/1991 | Lee ..... F17D 1/17 137/13 |
| 9,528,350 | B2 | | 12/2016 | Lunde et al. |
| 2009/0242201 | A1 | | 10/2009 | Van Beurden |
| 2011/0220354 | A1 | | 9/2011 | Eikaas et al. |
| 2011/0232907 | A1 | | 9/2011 | Bryant et al. |
| 2014/0262283 | A1 | | 9/2014 | Savari et al. |
| 2015/0275611 | A1 | | 10/2015 | Minnock et al. |
| 2015/0275612 | A1 | | 10/2015 | Minnock et al. |
| 2015/0275613 | A1 | | 10/2015 | Minnock et al. |
| 2015/0275614 | A1 | | 10/2015 | Minnock et al. |

OTHER PUBLICATIONS

U.S. Appl. No. 14/681,971, filed Apr. 8, 2015, Michael David Mullin.

* cited by examiner

SYSTEM AND METHOD FOR FLUID INJECTION

CROSS-REFERENCE TO RELATED APPLICATION

This application claims the benefit of U.S. Provisional Patent Application No. 62/107,317, filed Jan. 23, 2015, entitled "SYSTEM AND METHOD FOR FLUID INJECTION," which is incorporated by reference herein in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Wells are often used to access resources below the surface of the earth. For instance, oil, natural gas, and water are often extracted via a well. Some wells are used to inject materials below the surface of the earth, e.g., to sequester carbon dioxide, to store natural gas for later use, or to inject steam or other substances near an oil well to enhance recovery. Due to the value of these subsurface resources, wells are often drilled at great expense, and great care is typically taken to extend their useful life. Chemical injection systems are often used to maintain a well and/or enhance well output. For example, chemical injection systems may inject chemicals to extend the life of a well or to increase the rate at which resources are extracted from a well.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

Figure 1:
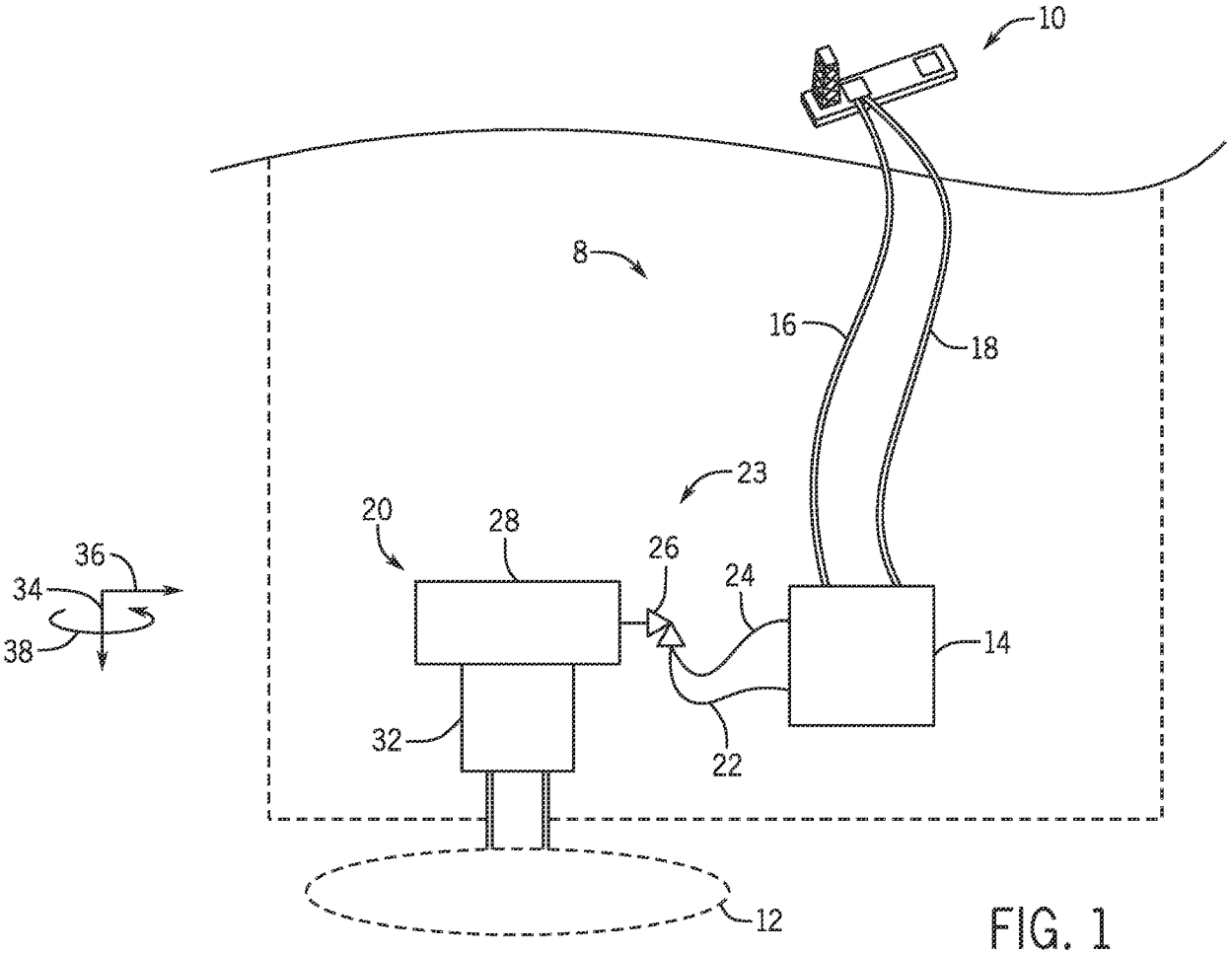
FIG. 1 is a schematic of an embodiment of a fluid injection system, in accordance with an embodiment of the present disclosure.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The present embodiments are generally directed to systems and methods for fluid injection. More particularly, the present embodiments are directed to systems and methods for reducing chemical degradation during supply and injection of the chemical into a well and a mineral formation. In some cases, the chemical may be a liquid or powder long-chain polymer or other polymer. When mixed with a processing fluid (e.g., water), the polymer may increase the viscosity of the water, and the viscous mixture of polymer and water may be utilized to improve flow of production fluids in the mineral formation. As will be appreciated, a polymer may be delivered to a site (e.g., a floating production storage and offloading (FPSO) unit or other floating vessel) as an emulsion product. That is, the polymer (e.g., long-chain polymer) may be tightly coiled within water droplets and may have a low viscosity. Prior to injection into the mineral formation, it may be desirable to invert the polymer (e.g., invert the emulsion) by mixing the polymer with the water, for example, to uncoil the polymer chains into a ribbon form. However, when the polymer is in ribbon form, the polymer may be susceptible to shear forces and acceleration forces that can cause the polymer to degrade, and therefore be less effective and viscous. Without the disclosed embodiments, fluid injection systems may mix the polymer with the water to completely invert the polymer prior to passing through a choke valve that is configured to inject the polymer and water mixture into the well. The choke valve subjects the mixture to large pressure changes, shear forces, and/or acceleration forces, and thus, such fluid injection systems may cause degradation of the polymer and may make the mixture of polymer and water less viscous and less effective.

As mentioned above, the polymer may be a long-chain polymer, which may be susceptible to shear forces and/or acceleration forces when inverted. Thus, flowing the polymer through the choke valve or similar flow control components while the polymer is in ribbon form may result in degradation of the polymer. To reduce degradation of the polymer caused by shear forces and/or acceleration forces, certain disclosed embodiments are configured to flow the polymer in an incompletely inverted state into the choke valve (e.g., by mixing the polymer with the water directly upstream of the choke valve or proximate to an inlet of the choke valve). Additionally, certain disclosed embodiments are configured to independently (e.g., separately from the water) flow the polymer, in a non-inverted state (e.g., a substantially non-inverted state) or an incompletely inverted state, directly into the choke valve (e.g., via a polymer inlet). In the disclosed embodiments, the choke valve may subject the polymer and the water to shear forces and/or acceleration forces, thereby facilitating mixing of the polymer and water, as well as inversion of the polymer as the polymer passes through the choke and/or as the polymer is injected into a main bore (e.g., a production bore) of the well. Advantageously, in the disclosed embodiments, the polymer is not fully inverted and then subjected to the high pressure drop across the choke valve, which may cause polymer degradation.

With the foregoing in mind, FIG. 1 is a schematic illustrating an embodiment of a fluid injection system 8. As shown, a topside unit 10 (e.g., floating production storage and offloading (FPSO)), may supply one or more injection fluids (e.g., water, polymer, etc.) to a subsea mineral formation 12. In particular, a processing fluid (e.g., water) may be supplied to a subsea distribution unit 14 via a water supply line 16, and the polymer may be supplied to the subsea distribution unit 14 via a polymer supply line 18. Additionally, the water may be distributed from a water supply of the subsea distribution unit 14 to a well 20 via a water injection line 22, and the polymer may be distributed from a polymer supply of the subsea distribution unit 14 to the well 20 via a polymer injection line 24. As discussed in more detail below, a fluid injection assembly 23 may include a choke valve 26 disposed in what is colloquially referred to as a "christmas" tree 28 (e.g., tree) to facilitate flow of the water and the polymer into a well head 32. As discussed in more detail below, in some embodiments, the choke valve 26 may be an adjustable choke valve, and a controller may be coupled to an actuator and may control the actuator to adjust the choke valve 26 and the pressure differential across the choke valve 26.

In the disclosed embodiments, the water and the polymer, in a non-inverted state or an incompletely inverted state, are combined at or proximate to the choke valve 26. The choke valve 26 may facilitate mixing of the polymer and water, thereby facilitating inversion of the polymer as the polymer passes through the choke valve 26 and/or as the polymer is injected into the well 20. For example, in some embodiments, the choke valve 26 may cause the polymer to invert by at least approximately 5, 10, 20, 30, 40, 50, 60, 70, 80, 90, or 100 percent as the polymer travels through the choke valve 26. The inverted polymer and water mixture travels through a main bore (e.g., production bore) of the well 20 toward the mineral formation 12. As noted above, in the disclosed embodiments, the polymer is not fully inverted and then subjected to the high pressure drop across the choke valve 26, and thus, polymer degradation is reduced or eliminated.

To facilitate discussion, the well 20 may be described with reference to an axial axis or direction 34, a radial axis or direction 36, and a circumferential axis or direction 38. Although one subsea distribution unit 14 and one well 20 are shown in FIG. 1 to facilitate discussion, it should be understood that the water may be supplied by the topside unit 10 to multiple subsea distribution units 14 via respective water supply lines 16 and/or the polymer may be supplied by the topside unit 10 to multiple subsea distribution units 14 via respective polymer supply lines 18. Additionally, the water may be distributed from each subsea distribution unit 14 to multiple wells 20 via respective water injection lines 22 and/or the polymer may be distributed from each subsea distribution unit 14 to multiple wells 20 via respective polymer injection lines 24. In certain embodiments, the topside unit 10 may supply the water and the polymer to the choke valve 26 of the well 20, e.g., via the water supply line 16 and the polymer supply line 18, respectively, without use of the subsea distribution unit 14. Further, the embodiments disclosed herein may be adapted for use with surface wells (e.g., the polymer and water may be distributed separately toward a choke valve or other flow control device of a surface well, and the choke valve or flow control device may facilitate inversion of the polymer, as discussed herein).

Figure 2:
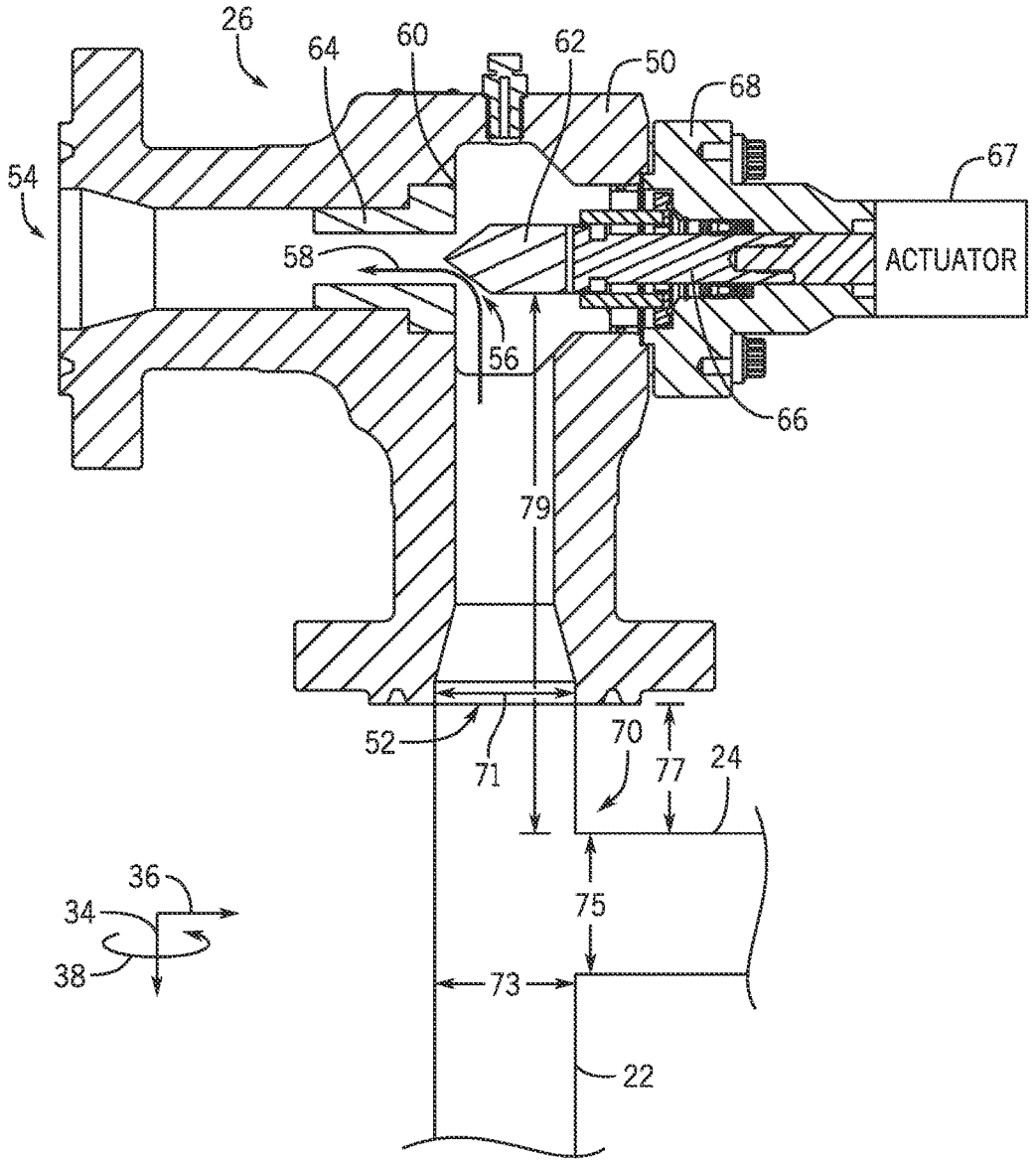
FIG. 2 is a cross-sectional side view of a portion of a choke valve of the fluid injection system of FIG. 1, wherein a polymer injection line is coupled to a water injection line proximate to an inlet of the choke valve, in accordance with an embodiment.

FIG. 2 is a cross-sectional side view of a portion of the choke valve 26 of FIG. 1, in accordance with an embodiment. In the illustrated embodiment, the choke valve 26 includes a choke body 50, an inlet 52, and an outlet 54. The water injection line 24 is coupled to the inlet 52 and provides a fluid (e.g., a mixture of the water and the polymer) that travels through the inlet 52. The mixture of the water and the polymer flows through a throttling orifice 56 of the choke valve 26, as shown by arrows 58 (e.g., a fluid flow path) and toward the outlet 54.

In the illustrated embodiment, the choke valve 26 includes a choke trim 60 configured to throttle flow of the water and the polymer. As shown, the choke trim 60 includes a needle 62 and a seat 64 (e.g., an annular seat), although the choke trim 60 may have any suitable configuration, such as a plug and cage trim, an external sleeve trim, a wedge trim, or a low shear trim, to throttle flow of the water and the polymer. A stem 66 is coupled to the choke trim 60 and is supported by a bonnet 68 coupled to the choke body 50. In embodiments where the choke valve 26 is adjustable, the stem 66 may be coupled to an actuator 67 (e.g., an electronic or manual actuator) configured to drive the stem 66. In such cases, the needle 62 of the choke trim 60 may move relative to the seat 64 to adjustably throttle flow of the water and the polymer. In some cases, a controller may be coupled to and may control the actuator 67. Additionally or alternatively, the controller may control a flow rate of the water into the choke valve 26 and/or a flow rate of the polymer into the choke valve 26 (e.g., via controlling respective valves or the like) to facilitate and/or to control mixing and inversion of the polymer. The controller may be an electronic controller having electrical circuitry configured to process data from one or more sensors and/or other components of the system 8. The controller includes a processor and a memory device. The controller may also include one or more storage devices and/or other suitable components. The processor may be used to execute software, such as software for controlling the actuator, the flow rates, and so forth. The memory device may include a volatile memory, such as random access memory (RAM), and/or a nonvolatile memory, such as ROM. The memory device may store a variety of information and may be used for various purposes. For example, the memory device may store processor-executable instructions (e.g., firmware or software) for the processor to execute, such as instructions for controlling the actuator, the flow rates, and so forth. The storage device(s) (e.g., nonvolatile storage) may include read-only memory (ROM), flash memory, a hard drive, or any other suitable optical, magnetic, or solid-state storage medium, or a combination thereof. The storage device(s) may store data (e.g., choke valve 26 characteristics, flow rates, etc.), instructions (e.g., software or firmware for controlling components of the system 8, etc.), and any other suitable data.

As shown, the polymer flows into the water injection line 22 directly upstream of the choke valve 26 (e.g., proximate to the inlet 52) at a junction 70 between the water injection line 22 and the polymer injection line 24. The time for the polymer to invert after being exposed to water may vary based on certain factors, such as the type of polymer, for example. Thus, the position of the junction 70 relative to the inlet 52 and/or to the throttling orifice 56 of the choke valve 26 may vary or be selected based on the type of polymer and/or other factors to facilitate delivery of the polymer in an incompletely inverted state to the choke valve 26 and/or to facilitate inversion of the polymer as the polymer flows through the choke valve 26. For example, in some embodiments, the junction 70 between the polymer injection line 24 and the water injection line 22 may be less than approximately 0.25, 0.5, 0.75, 1, 2, 3, 4, 5, or 10 meters from the inlet 52 and/or from the throttling orifice 56. In some embodiments, the junction 70 between the polymer injection line 24 and the water injection line 22 may be less than approximately 0.25, 0.5, 0.75, 1, 2, 3, 4, 5, or 10 kilometers from the inlet 52 and/or from the throttling orifice 56.

By way of another example, in some embodiments, the position of the junction 70 relative to the inlet 52 and/or the throttling orifice 56 may be based at least in part on a diameter 71 of the inlet 52, a diameter 73 of the water injection line 22 at the junction 70, and/or a diameter 75 of the polymer injection line 24 at the junction 70. For example, the junction 70 may be positioned at a distance 77 from the inlet 52 and/or a distance 79 from the throttling orifice 56 that is less than approximately 1, 2, 3, 4, 5, 10, 15, 20, 30, 40, or 50 times the diameter 71 of the inlet 52, the diameter 73 of the water injection line 22 at the junction 70, and/or the diameter 75 of the polymer injection line 24 at the junction 70. Additionally or alternatively, the position of the junction 70 relative to the inlet 52 and/or the throttling orifice 73 may be based at least in part on a flow rate of the polymer and/or the water. In some embodiments, a flow rate of the polymer and/or the water through the inlet 52 may be adjusted (e.g., by adjusting the diameter 71 of the inlet 52, the diameter 73 of the water injection line 22, and/or the diameter 75 of the polymer injection line 24, and/or by adjusting flow rates of the polymer and/or the water through the respective lines 22, 24). Adjusting the flow rate through the inlet 52 may affect the time it takes for the polymer and water mixture to travel from the junction 70 to the choke valve 26, and thus, may affect the degree of polymer inversion that occurs between the junction 70 and the inlet 52 and/or the throttling orifice 56 of the choke valve 26. For example, the flow rate may be adjusted such that polymer inversion is limited prior to flowing the polymer through the choke valve 26. The flow rates and/or the diameters may be adjusted via any suitable flow control devices (e.g. valves) and/or actuators (e.g., manual actuators, hydraulic actuators, pneumatic actuators, or the like), which may be controlled by a controller having a processor configured to execute instructions stored in a memory of the controller as discussed above, for example.

In certain embodiments, the polymer may be partially inverted (e.g., incompletely inverted or less than approximately 5, 10, 15, 20, 25, 30, 35, 40, 45, 50, 55, 60, 65, 70, 75, 80, 85, 90, or 95 percent inverted) prior to passing through the inlet 52 and/or prior to flowing through the throttling orifice 56. In such cases, the choke valve 26 may facilitate mixing of the polymer and the water and inversion of the polymer as the water and the polymer flow through the throttling orifice 56. Thus, the polymer flowing through the outlet 54 may be more completely inverted (e.g., an increase of more than approximately 5, 10, 20, 30, 40, 50, 60, 70, 80, 90 percent) than the polymer flowing through the inlet 52. That is, the choke valve 26 causes the polymer to invert by at least approximately 5, 10, 20, 30, 40, 50, 60, 70, 80, 90 percent or more as the polymer travels through the choke valve 26. In some embodiment, the percentage of inversion may depend on various factors, such as the type of polymer, the shear forces and/or acceleration forces, and/or the pressure differential across the choke valve 26, for example. Furthermore, in some embodiments, the polymer flowing through the outlet 54 may be at least substantially or completely inverted (e.g., more than approximately 75, 80, 85, 90, 95, or 100% percent inverted).

Figure 3:
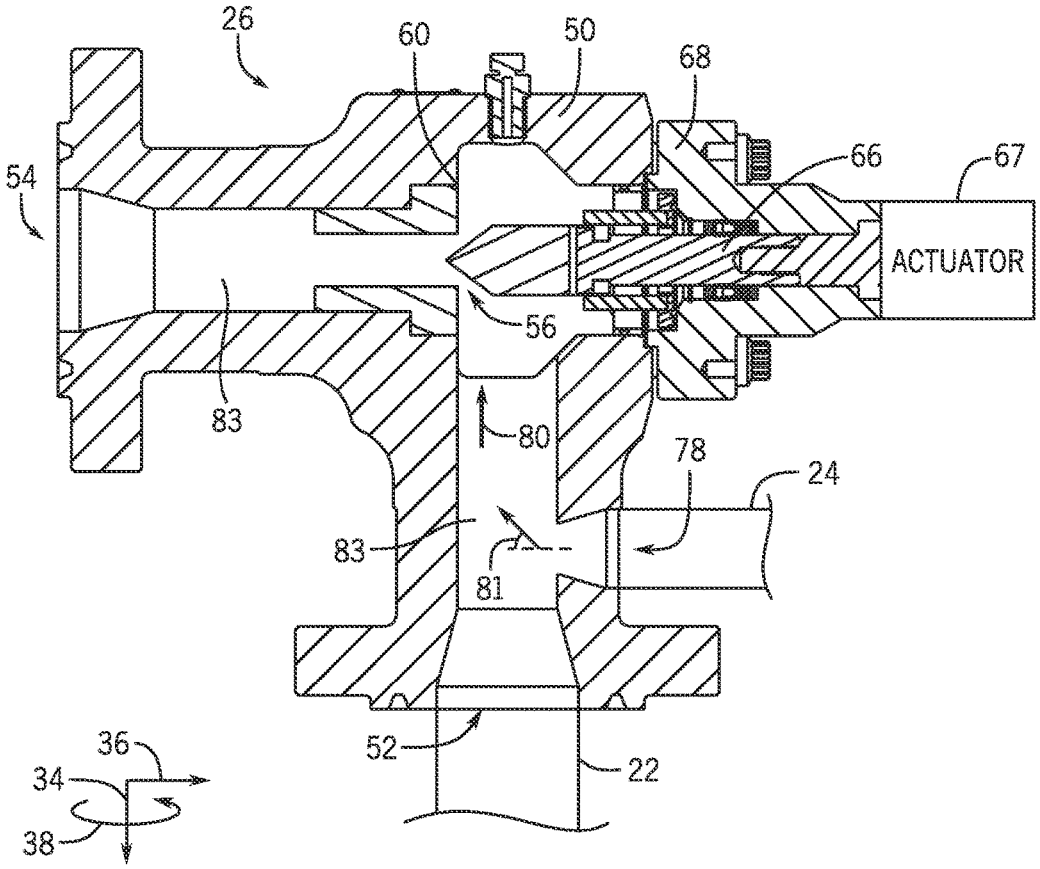
FIG. 3 is a cross-sectional side view of a portion of a choke valve of the fluid injection system of FIG. 1, wherein a body of the choke valve includes a polymer inlet and a water inlet, in accordance with an embodiment.

FIG. 3 is a cross-sectional side view of a portion of the choke valve 26 of the fluid injection system 8 of FIG. 1, in accordance with an embodiment. As shown, the choke valve 26 includes the inlet 52 and a separate (e.g., independent or dedicated) polymer inlet 78 disposed within the choke body 50 upstream of the throttling orifice 56 and the choke trim 60. The water injection line 22 is coupled to the inlet 52, and the polymer injection line 24 is coupled to the polymer inlet 78. The polymer injection line 24 provides the polymer in a non-inverted state (e.g., less than 1, 2, 3, 4, 5, 10, 15, 20, 25, 30, 35, 40, 45, or 50 percent inverted) to the polymer inlet 78. The water and the polymer may flow toward the throttling orifice 56, as shown by arrow 80, and the choke valve 26 facilitates mixing of the water and the polymer and/or inversion of the polymer as the water and the polymer flow through the throttling orifice 56 and toward the outlet 54. In some embodiments, the choke valve 26 causes the polymer to invert by at least approximately 5, 10, 20, 30, 40, 50, 60, 70, 80, 90 percent or more as the polymer travels through the choke valve 26. In some cases, a controller may be coupled to and may control the actuator 67. Additionally or alternatively, the controller may control a flow rate of the water into the choke valve 26 and/or a flow rate of the polymer into the choke valve 26 (e.g., via controlling respective valves or the like) to facilitate and/or to control mixing and inversion of the polymer.

Although an axis of the polymer inlet 78 is shown as generally aligned with the radial axis 36 of the choke valve 26 and generally perpendicular to the axial axis 34 of the choke valve 34 and to the flow of water through the inlet 52, in certain embodiments, the polymer inlet 78 may be oriented at an angle 81 (e.g., approximately 5, 10, 15, 20, 25, 30, 35, 40, or 45 degrees, or between approximately 5-75, 10-60, 20-50, or 30-45 degrees) relative to the radial axis 36, thereby enabling the polymer to be injected into the choke valve 26 in an upstream (e.g., angled upstream) or downstream (e.g., angled downstream) flow direction. Additionally, in some embodiments, the polymer inlet 78 may be oriented relative to the choke valve 26 to inject the polymer in the circumferential direction 38 about the axial axis 34 to induce swirl. The polymer inlet 78 may be oriented at any suitable angle 81 relative to the radial axis 36, and/or at any suitable angle relative to the axial axis 34 and/or angled in the circumferential direction to enable flow of the polymer into the choke valve 26 to facilitate mixing and inversion of the polymer within the choke valve 26. In some embodiments, multiple polymer inlets 78 may be positioned radially across a conduit 83 of the choke valve 26 from one another and/or the polymer inlet 78 may be positioned radially across the conduit 83 of the choke valve 26 from a water inlet to induce impingement (e.g., contact or collision) within the conduit 83 and thereby facilitate mixing and inversion of the polymer.

Additionally, although the polymer inlet 78 is illustrated upstream of the throttling orifice 56 and the choke trim 60, it should be understood that the polymer inlet 78 may be disposed in any suitable portion of the choke body 50. For example, in some embodiments, the polymer inlet 78 may be disposed downstream of the throttling orifice 56 and the choke trim 60, and the polymer and the water may mix as the polymer and the water travel toward the outlet 54 and/or into the well 20, shown in FIG. 1. Furthermore, although one polymer inlet 78 is illustrated to facilitate discussion, in some embodiments, multiple polymer inlets 78 may be provided in the choke body 50 and/or in other portions of the choke valve 26. For example, one or more polymer inlets 78 may be provided upstream of the choke trim 60, while one or more polymer inlets 78 may be provided downstream of the choke trim 60. In some embodiments, one or more polymer inlets 78 may be provided in the choke body 50 and/or in other portions of the choke valve 26 to receive at least some of the polymer, and at least some of the polymer may be mixed with the water upstream of the inlet 52 of the choke valve 26 in the manner discussed above with respect to FIG. 2. Indeed, any of the embodiments and various features disclosed herein may be used in any suitable combination.

Figure 4:
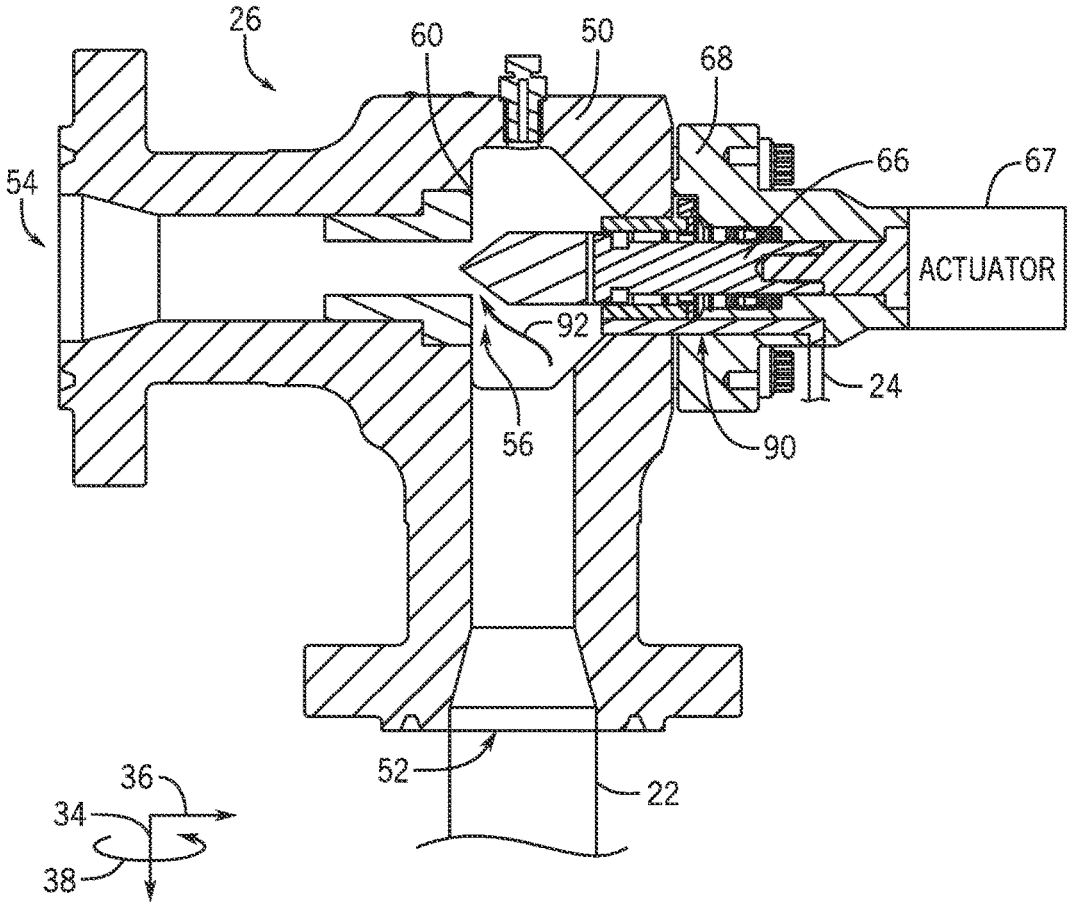
FIG. 4 is a cross-sectional side view of a portion of a choke valve of the fluid injection system of FIG. 1, wherein a bonnet of the choke valve includes a polymer inlet, in accordance with an embodiment.

FIG. 4 is a cross-sectional side view of a portion of the choke valve 26 of the fluid injection system 8 of FIG. 1, in accordance with an embodiment. As shown, the choke valve 26 includes the inlet 52 and a separate polymer inlet 90 disposed within the bonnet 68. The water injection line 22 is coupled to the inlet 52, and the polymer injection line 24 is coupled to the polymer inlet 90. The polymer injection line 24 provides the polymer in a non-inverted state or a substantially non-inverted state (e.g., less than approximately 1, 2, 3, 4, 5, 10, 15, 20, 25, 30, 35, 40, 45, or 50 percent inverted) to the polymer inlet 90. In the illustrated embodiment, the polymer is provided upstream of the throttling orifice 56 and the choke trim 60, and thus, the water and the polymer may flow through the throttling orifice 56, as shown by arrow 92. The choke valve 26 facilitates mixing of the water and the polymer and/or inversion of the polymer as the water and the polymer flow through the throttling orifice 56 and toward the outlet 54. In some embodiments, the choke valve 26 causes the polymer to invert by at least approximately 5, 10, 20, 30, 40, 50, 60, 70, 80, 90 percent or more as the polymer travels through the choke valve 26. In some cases, a controller may be coupled to and may control the actuator 67. Additionally or alternatively, the controller may control a flow rate of the water into the choke valve 26 and/or a flow rate of the polymer into the choke valve 26 (e.g., via controlling respective valves or the like) to facilitate and/or to control mixing and inversion of the polymer.

As discussed above, the polymer inlet 90 may be oriented at an angle relative to the radial axis 36, thereby enabling the polymer to be injected into the choke valve 26 in an upstream (e.g., angled upstream) or downstream (e.g., angled downstream) flow direction. The polymer inlet 90 may be oriented at any suitable angle to enable flow of the polymer into the choke valve 26 to facilitate mixing and inversion of the polymer. Additionally, although one polymer inlet 90 is illustrated to facilitate discussion, in some embodiments, multiple polymer inlets 90 may be provided in the bonnet 68 and/or in other portions of the choke valve 26. For example, one or more polymer inlets 90 may be provided in the bonnet 68, while one or more polymer inlets 78 may be provided in the choke body 50 either upstream or downstream of the choke trim 60, as discussed above. In some embodiments, one or more polymer inlets 78, 90 may be provided in the choke valve 26 to receive at least some of the polymer, and at least some of the polymer may be mixed with the water upstream of the inlet 52 of the choke valve 26 in the manner discussed above with respect to FIG. 2. Indeed, any of the embodiments and various features disclosed herein may be used in any suitable combination.

Figure 5:
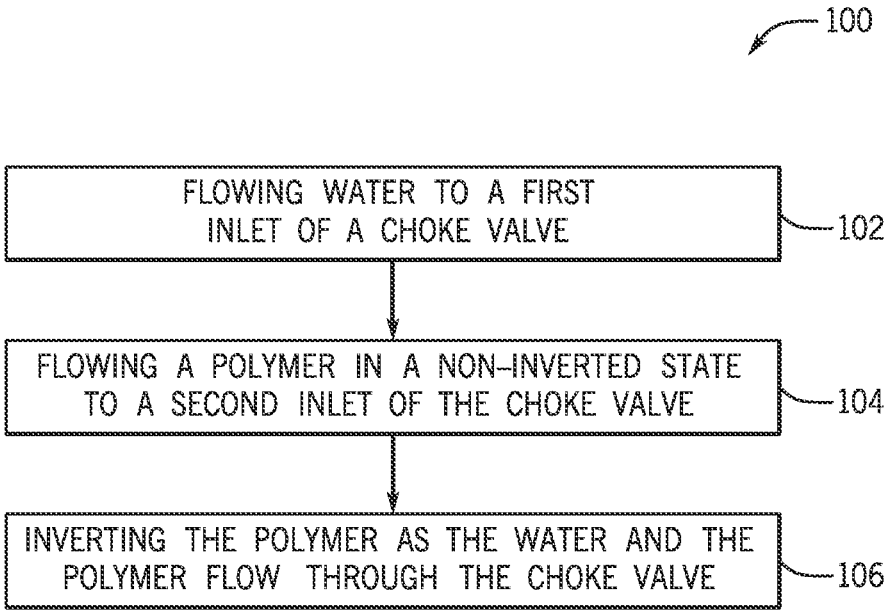
FIG. 5 is a flow diagram of an embodiment of a method for injecting a polymer into a well.

FIG. 5 is a flow diagram of an embodiment of a method 100 for injecting the polymer into the well 20. The method includes independently flowing water to the inlet 52 of the choke valve 26 via the water injection line 22, in step 92. The method also includes independently flowing the polymer in a non-inverted state to the polymer inlet 78, 90 of the choke valve 26, in step 94. The polymer mixes with the water and/or is subjected to shear and/or acceleration forces as the polymer and the water flow through the choke valve 26, and the polymer is thereby inverted as the polymer flows through the choke valve 26, in step 96. In some embodiments, the polymer is injected in an inverted state (e.g., a completely inverted state, such as more than 75, 80, 85, 90, or 95 percent inverted) into the main bore of the well 20. As discussed above, the polymer inlet 78, 90 may be disposed in any suitable position of the choke valve 26, such as in the choke body 50 or in the bonnet 58. In certain embodiments, the polymer inlet 78, 90 may be disposed upstream of the choke trim 60 of the choke valve 26.

As discussed above, to reduce degradation of the polymer caused by shear forces and/or acceleration forces, certain disclosed embodiments are configured to flow the polymer in an incompletely inverted state into the choke valve 26 (e.g., by mixing the polymer with the water directly upstream of the choke valve 26 or proximate to the inlet 52 of the choke valve 26). Additionally, certain disclosed embodiments are configured to independently (e.g., separately from the water) flow the polymer in a non-inverted state directly into the choke valve 26 (e.g., via the polymer inlet 78, 90). In the disclosed embodiments, the choke valve 26 may facilitate mixing of the polymer and water, thereby facilitating inversion of the polymer as the polymer passes through the choke valve 26 and/or as the polymer is injected into the well 20. The inverted polymer and water mixture travels through a main bore (e.g., production bore) of the well 20 toward the mineral formation 12. Advantageously, in the disclosed embodiments, the polymer is not subjected to the high pressure drop across the choke valve 26 while the polymer is completely inverted, thereby limiting or reducing polymer degradation.

Figure 6:
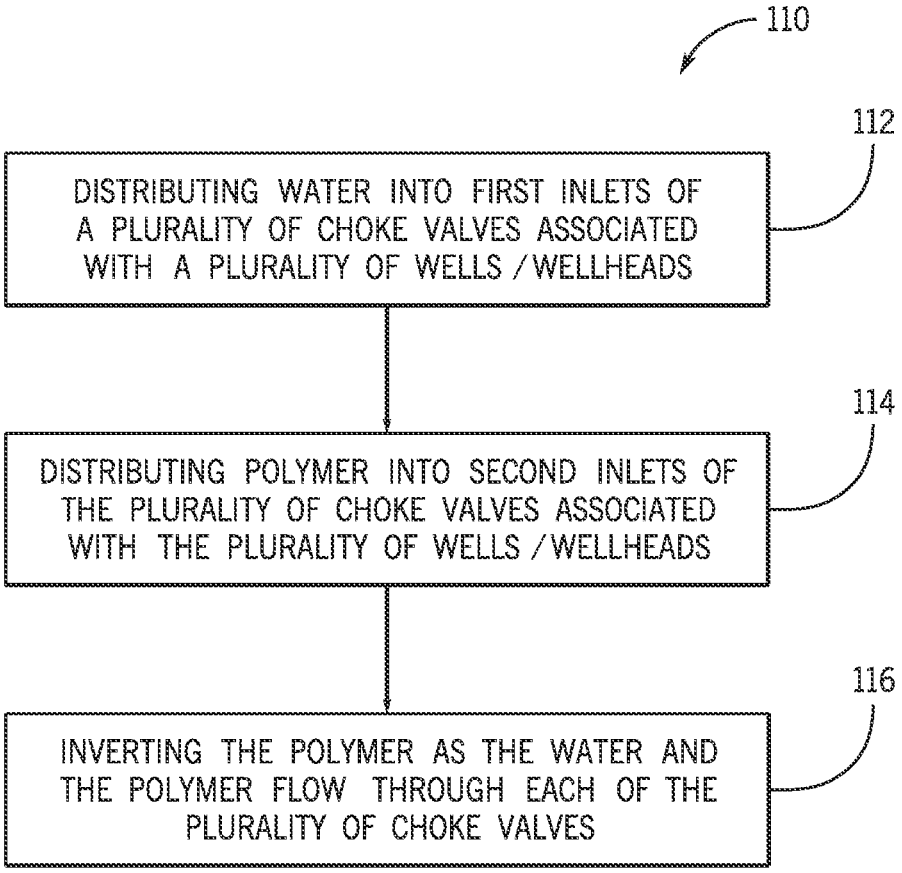
FIG. 6 is a flow diagram of an embodiment of a method for injecting a polymer into a plurality of wells.

FIG. 6 is a flow diagram of an embodiment of a method 110 for injecting the polymer into a plurality of wells 20, e.g., in an oilfield. The method 110 of FIG. 6 is similar to the method 100 of FIG. 5, except that the method 110 relates to a plurality of wells 20 and associated choke valves 26. Therefore, the foregoing discussion pertaining to FIG. 5 generally applies to the embodiment of FIG. 6 as well. In step 112 of the illustrated embodiment, the method 110 includes flowing or distributing water into first inlets of a plurality of choke valves 26 associated with a plurality of wells 20 and/or well heads 32 via one or more water injection systems. In step 114 of the illustrated embodiment, the method 110 includes flowing or distributing polymer (e.g., in a non-inverted state or a substantially non-inverted state) into second inlets of the plurality of choke valves 26 associated with the plurality of wells 20 and/or well heads 32 via one or more polymer injection systems. In step 116, the method 110 includes inverting the polymer as the water and the polymer flow through each of the plurality of choke valves 26 associated with the plurality of wells 20 and/or well heads 32, thereby facilitating inversion of the polymer. As discussed above, the polymer inlet 78, 90 may be disposed in any suitable position on each of the plurality of choke valves 26, such as in the choke body 50 or in the bonnet 58. In certain embodiments, the polymer inlet 78, 90 may be disposed upstream of the choke trim 60 of the choke valve 26.

In certain embodiments, the method may distribute the water and/or the polymer to one, all, or a subset of the plurality of choke valves 26 associated with the plurality of wells 20 and/or well heads 32 via a common water injection system and/or a common polymer injection system. For example, the common water injection system may include a common header or water distribution unit, which distributes the water through a plurality of conduits to the plurality of choke valves 26, the plurality of wells 20, and/or the plurality of well heads 32. Likewise, the common polymer injection system may include a common header or polymer distribution unit, which distributes the polymer through a plurality of conduits to the plurality of choke valves 26, the plurality of wells 20, and/or the plurality of well heads 32. The water distribution unit and the polymer distribution unit may be located on-site or remote relative to the plurality of choke valves 26, the plurality of wells 20, and/or the plurality of well heads 32. For example, the water distribution unit and the polymer distribution unit may be mounted to a topside facility. The method may provide common control (e.g., via a common valve) and/or independent control (e.g., via independent valves in each conduit) of the water flow to the plurality of choke valves 26, the plurality of wells 20, and/or the plurality of well heads 32. Likewise, the method may provide common control (e.g., via a common valve) and/or independent control (e.g., via independent valves in each conduit) of the polymer flow to the plurality of choke valves 26, the plurality of wells 20, and/or the plurality of well heads 32. The method may include operation of a controller (e.g., a processor-based controller) coupled to the various valves and sensors distributed through the plurality of choke valves 26, the plurality of wells 20, and/or the plurality of well heads 32, thereby enabling control of the flow rates and pressures of the water and polymer delivered to each of the choke valves 26. For example, the method may operate the controller to tailor the flow of water and polymer to each of the plurality of choke valves 26 based on various characteristics or conditions in each of the plurality of choke valves 26, the plurality of wells 20, and/or the plurality of well heads 32.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A fluid injection system for reducing a chemical degradation of a polymer during injection of the polymer into a well, comprising:

a choke valve comprising at least one inlet;

a water injection line extending between a water supply and the choke valve, wherein the water injection line is configured to flow water from the water supply into a first inlet of the at least one inlet of the choke valve;

a polymer injection line extending from a polymer supply toward the choke valve, wherein the polymer injection line is configured to flow the polymer in a substantially non-inverted state from the polymer supply toward the choke valve, and the choke valve is configured to receive the water and the polymer and to facilitate inversion of the polymer as the water and the polymer flow through the choke valve; and a controller configured to control a flow of the water from the water supply into the first inlet, to control a flow of the polymer from the polymer supply toward the choke valve, and to control an actuator to adjust a position of a movable component of the choke valve to adjust a size of a throttling orifice of the choke valve to facilitate inversion of the polymer by at least approximately five percent as the water and the polymer flow through the choke valve.

2. The system of claim 1, wherein the polymer injection line is coupled to the water injection line at a junction directly upstream of the first inlet of the at least one inlet of the choke valve, and the choke valve is configured to receive the polymer and the water through the first inlet of the at least one inlet of the choke valve.

3. The system of claim 2, wherein the choke valve is configured to receive the polymer in an incompletely inverted state prior to flowing through a choke trim of the choke valve.

4. The system of claim 2, wherein polymer injection line is oriented at an angle between approximately 5 to 75 degrees relative to the water injection line at the junction.

5. The system of claim 1, wherein the water injection line is coupled to the first inlet of the at least one inlet of the choke valve, and the polymer injection line is coupled to a second inlet of the at least one inlet of the choke valve.

6. The system of claim 5, wherein the second inlet is disposed within a body of the choke valve, and the body circumferentially surrounds the movable component.

7. The system of claim 5, wherein the second inlet is disposed within a bonnet of the choke valve, and the bonnet circumferentially surrounds a stem that extends between the actuator and the movable component to enable the actuator to adjust the position of the movable component.

8. The system of claim 5, wherein the polymer is in the substantially non-inverted state as the polymer flows through the second inlet.

9. The system of claim 1, wherein the choke valve is disposed within a tree of a well head.

10. The system of claim 9, wherein the tree is positioned at a subsea location.

11. The system of claim 10, wherein the water supply and the polymer supply are part of a subsea distribution unit positioned at a subsea location.

12. A fluid injection system for reducing a chemical degradation of a polymer during injection of the polymer into a well, comprising:

a choke valve, comprising:

a choke trim comprising a movable component and a stationary component;

a choke body circumferentially surrounding the choke trim;

an actuator configured to adjust a position of the movable component relative to the stationary component to adjust a size of a throttling orifice defined between the movable component and the stationary component;

a bonnet coupled to the choke body and circumferentially surrounding a stem that extends between the movable component and the actuator;

a first inlet formed in the choke body, wherein the first inlet is configured to be coupled to a water injection line and configured to receive water from the water injection line; and a second inlet formed in the choke body or the bonnet, wherein the second inlet is configured to be coupled to a polymer injection line and configured to receive the polymer in a substantially non-inverted state from the polymer injection line, wherein the choke valve is configured to facilitate inversion of the polymer by at least approximately five percent as the water and the polymer flow through the choke valve.

13. The system of claim 12, wherein the second inlet is disposed upstream of the choke trim of the choke valve.

14. The system of claim 12, wherein the second inlet is disposed within the bonnet of the choke valve.

15. The system of claim 12, wherein the choke valve is coupled to a tree of a well head.

16. The system of claim 12, wherein the second inlet is disposed downstream of the choke trim of the choke valve.

17. The system of claim 12, wherein the choke valve comprises a third inlet formed in the choke body or the bonnet, and the third inlet is configured to be coupled to the polymer injection line and configured to receive the polymer in the substantially non-inverted state from the polymer injection line.

18. A method for reducing a chemical degradation of a polymer during injection of the polymer into a mineral formation, comprising:

independently flowing water to a first inlet of a choke valve;

independently flowing the polymer in a substantially non-inverted state to a second inlet of the choke valve;

inverting the polymer by at least approximately five percent as the water and the polymer flow through the choke valve; and injecting a mixture of the water and the polymer from an outlet of the choke valve into a main bore of a well head and toward the mineral formation.

19. The method of claim 18, wherein the second inlet is disposed within a body of the choke valve, the body circumferentially surrounds a movable component, and the method comprises operating a controller to control an actuator to move the movable component relative to the body to adjust a size of a throttling orifice of the choke valve.

20. The method of claim 18, wherein the second inlet is disposed within a bonnet of the choke valve, and the bonnet circumferentially surrounds a stem that extends between an actuator and the movable component to enable the actuator to adjust the position of the movable component.

* * * * *